US005129551A

United States Patent [19]

Gott

[11] Patent Number: 5,129,551

[45] Date of Patent: Jul. 14, 1992

[54] AUTOMATIC DISPENSING SYSTEM FOR LIQUIDS

[75] Inventor: Granville Gott, Chalfont St. Peter Bucks, United Kingdom

[73] Assignee: Imperial Chemical Industries PLC, London, England

[21] Appl. No.: 526,684

[22] Filed: May 22, 1990

Related U.S. Application Data

[63] Continuation of Ser. No. 434,547, Nov. 9, 1989, abandoned, which is a continuation of Ser. No. 161,762, Feb. 23, 1988, abandoned.

[30] Foreign Application Priority Data

Mar. 9, 1987 [GB] United Kingdom ..... 8705482

[51] Int. Cl.[5] ..... B67D 5/52

[52] U.S. Cl. ..... 222/135; 222/318; 222/380; 222/375; 222/496; 239/567; 137/509

[58] Field of Search ..... 222/318, 380, 375, 491–493, 222/495–497, 135, 136, 137, 129.1, 129.4, 482; 137/509; 239/533.7, 567, DIG. 14

[56] References Cited

U.S. PATENT DOCUMENTS

| | | | |
|---|---|---|---|
| 2,697,446 | 12/1954 | Harrington | 222/496 X |
| 2,787,402 | 4/1957 | Stiner et al. | 222/135 X |
| 2,876,935 | 3/1959 | Lindberg | 222/496 X |
| 2,923,438 | 2/1960 | Logan et al. | 222/135 X |
| 2,923,441 | 2/1960 | McConnohie | 222/996 X |
| 3,012,526 | 12/1961 | Baldwin et al. | 222/496 X |
| 3,015,415 | 1/1962 | Marsh et al. | 222/135 X |
| 3,097,671 | 7/1963 | Bonetti et al. | 222/496 X |
| 3,122,272 | 2/1964 | Marsh | 222/135 X |
| 3,537,653 | 11/1970 | Jones | 222/496 X |
| 3,592,367 | 7/1971 | Landis et al. | 222/496 X |
| 4,388,338 | 6/1983 | Wittenborg | 222/129.1 X |
| 4,392,588 | 7/1983 | Scalera | 222/129.4 |
| 4,473,173 | 9/1984 | DeGroff et al. | 222/318 X |
| 4,634,027 | 1/1987 | Kanarvogel | 222/496 X |
| 4,753,370 | 6/1988 | Rudick | 222/325 X |
| 4,967,938 | 11/1990 | Hellenberg | 222/135 |

FOREIGN PATENT DOCUMENTS

| | | | |
|---|---|---|---|
| 2715787 | 10/1978 | Fed. Rep. of Germany | 222/492 |
| 413505 | 7/1934 | United Kingdom | 222/496 |
| 862110 | 3/1961 | United Kingdom | 222/135 |

OTHER PUBLICATIONS

Translation into English of German Patent OPI 1 625 250 "Anti-Drip Mechanism for Field Spray Equipment", 4 pages.

Translation into English of German Patent OPI 28 05 942 "Mixer for Producing Homogenised Free-Flowing Products", 6 pages.

*Primary Examiner*—D. Glenn Dayoan
*Assistant Examiner*—Boris Milef
*Attorney, Agent, or Firm*—Cushman, Darby & Cushman

[57] ABSTRACT

A liquid dispensing system for example for paints comprises a liquid reservoir, a circulating path for the liquid to and from the reservoir, a pump for causing a pressurized flow around the path, a three-way valve in the path which is controllable to divert liquid from the path via a second valve to a dispensing nozzle. The second valve is biased to a closed position and is openable by the hydraulic pressure of the diverted liquid to permit the diverted liquid to flow to the nozzle. In a multiple liquid dispensing system, e.g. a paint blending system, each liquid has its own dispensing system as described above and the plurality of second valves thus provided are disposed in a conical formation with the nozzles directed towards the apex of the cone.

5 Claims, 4 Drawing Sheets

AUTOMATIC DISPENSING SYSTEM FOR LIQUIDS

This is a continuation of application Ser. No. 07/434,547, filed on Nov. 9, 1989, which was abandoned upon the filing hereof, which was a continuation of application Ser. No. 07/161,762, filed Feb. 23, 1988 (abandoned).

BACKGROUND OF THE INVENTION

This invention relates to dispensing systems for liquids and for suspensions, such as paints, having liquid carriers. Such liquids and suspensions will hereafter be referred to collectively as liquids.

The paint manufacturer is faced with the perennial problem of supplying to its customers many different coloured paints and usually more colours than the manufacturer can as a practical matter keep in stock. The problem is especially acute in the supply of paint for vehicle refinishing, that is to say in the supply of paint for respraying vehicles, for example, a crash repair. The difficulty is that vehicle manufacturers supply their vehicles in many different colours and in subtly different shades. Even for a given make, model and colour slight variants can arise between the exact colours of particular cars because of variants in the batches of paint used in manufacture. Moreover, commercial transport operators often wish to respray their vehicles in their own distinctive liveries. As a result, the number of paint colours in use is extensive and may be as high as 30,000.

Paint manufacturers succeed in providing the large number of colours called for by a method of blending. A number of basic or standard colours are produced that usually contain a single pigment but may contain a major proportion of one pigment and a minor amount of another sufficient to produce the standard colour. A typical standard range will contain from 20 to 50 basic colours which can be blended to give thousands of other colours. Thus, the refinisher or refinish paint supplier is in the position that it needs to stock between 20 to 50 colours only depending upon the particular range of paints that it wishes to supply.

In order to match the cars the refinisher repairs, the refinisher must mix these paints very carefully and very accurately against a formula or mixing scheme which is supplied by the paint manufacturer. The mixing scheme will set out the proportions of basic colours which have to be mixed to match the exact colour of the particular make, model and colour variant of the repaired car.

It is important that the basic colours are supplied and maintained in a very consistent condition. It is also important that they be dispensed very accurately indeed, against a formulation which is accurate to start with.

In providing an ideal dispensing system for use in paint blending there are certain desirable objectives, namely (1) accurate blending
(2) efficient operation without maintenance problems.
(3) automatic operation
(4) low cost In automatic dispensing systems there is usually a requirement to have some form of recirculation of the paint to prevent settling of the pigment.

There are several disadvantages in the systems on sale today, one of which is the large size of valves used and from which the paint is required to be dispensed into say either a 2½ liter container or a 1 tonne container as selected. The consequence of having a number of bulky valves is that it is impossible to position all of them above a container of any practical size. Thus one has an immediate problem of directing the paint to be dispensed into the container. There are two obvious solutions. One is to move the container every time a dispense is required so that the centre of the container is positioned under the valve to be used for that particular dispense. This is obviously inconvenient and can be error prone. It is particularly inconvenient in the case of machines where the container may weigh one tonne or more. An alternative way is to move the valves to always position the valve which is about to dispense above the centre of the container. There are at least two known ways of doing this. In one method the machine has a huge crescent shaped carriage on which the valves are mounted and this carriage swings around in a great arc in order to position each of the valves above a container. Because the valves swing by such a large amount (several metres) the pipes leading to the valve have to be flexible. Not only that but since the length of pipe varies as the mounting plate swivels there has to be some other means of adjusting the length which in turn involves another compensating mechanism with flexible hoses. The degree of complexity that would be introduced if one had recirculation within these flexible pipes is so immense that the requirement of recirculation has to be omitted.

SUMMARY OF THE INVENTION

The object of the invention is to provide an automatic dispensing system having recirculation and whose dispensing valves are of such design that they can be made sufficiently small to be grouped together over a target container as small as 1 liter to provide the typically required number of basic colours for blending without having to move the container.

According to the present invention, a liquid dispensing system comprises a circulating path for the liquid to and from a reservoir, means for pressurising the liquid to cause it to circulate around said path, a first valve means controllable to divert the liquid from the circulating path to a dispensing nozzle and a second valve means past which the diverted liquid flows, the second valve means being biased to a closed position and being openable by the hydraulic pressure of the liquid to permit the liquid to be passed through it to the nozzle.

In application of the invention to a paint blending system one such dispensing system will be provided for each basic colour.

The first and second valve means need not be positioned adjacent each other but could be interconnected by a liquid feed line. The second valve means can be designed as a relatively slim valve and does not have to carry bulky actuating means. Consequently a relatively large number of them can be disposed close together for feeding paint into a target container.

Advantageously, in application of the invention to a paint blending system, the bodies of the plurality of second valve means are arranged as a group to form an inverted conical shape with the nozzles directed towards the apex of the cone. Ideally the target container at a filling station is arranged so that the apex of the cone lies on its vertical axis and within the container.

BRIEF DESCRIPTION OF THE DRAWING

The invention will now be further described by way of example as applied to a paint blending system and with reference to the accompanying drawings in which.

DETAILED DESCRIPTION

Figure 1:
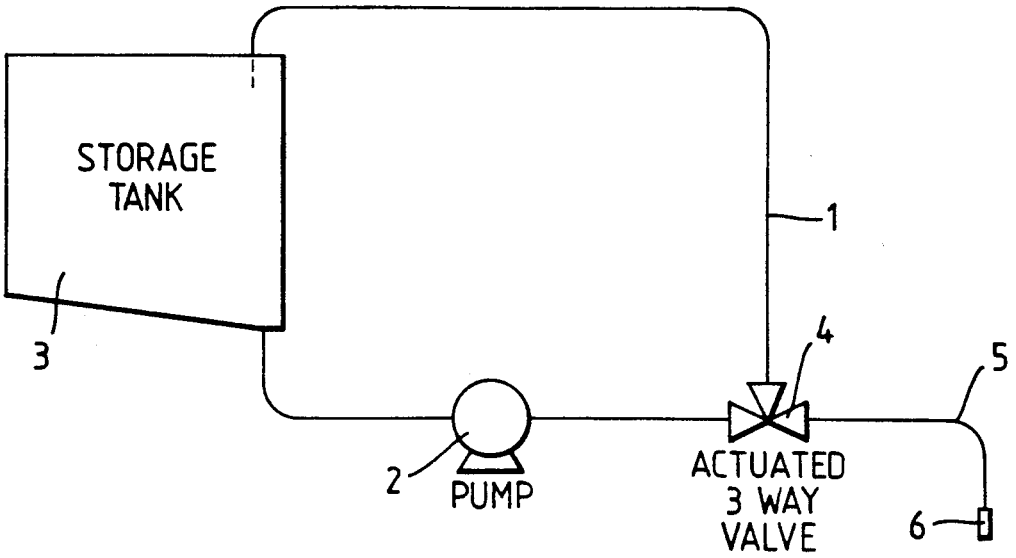
FIG. 1 shows a schematic diagram of one dispensing system in accordance with the invention
Figure 5:
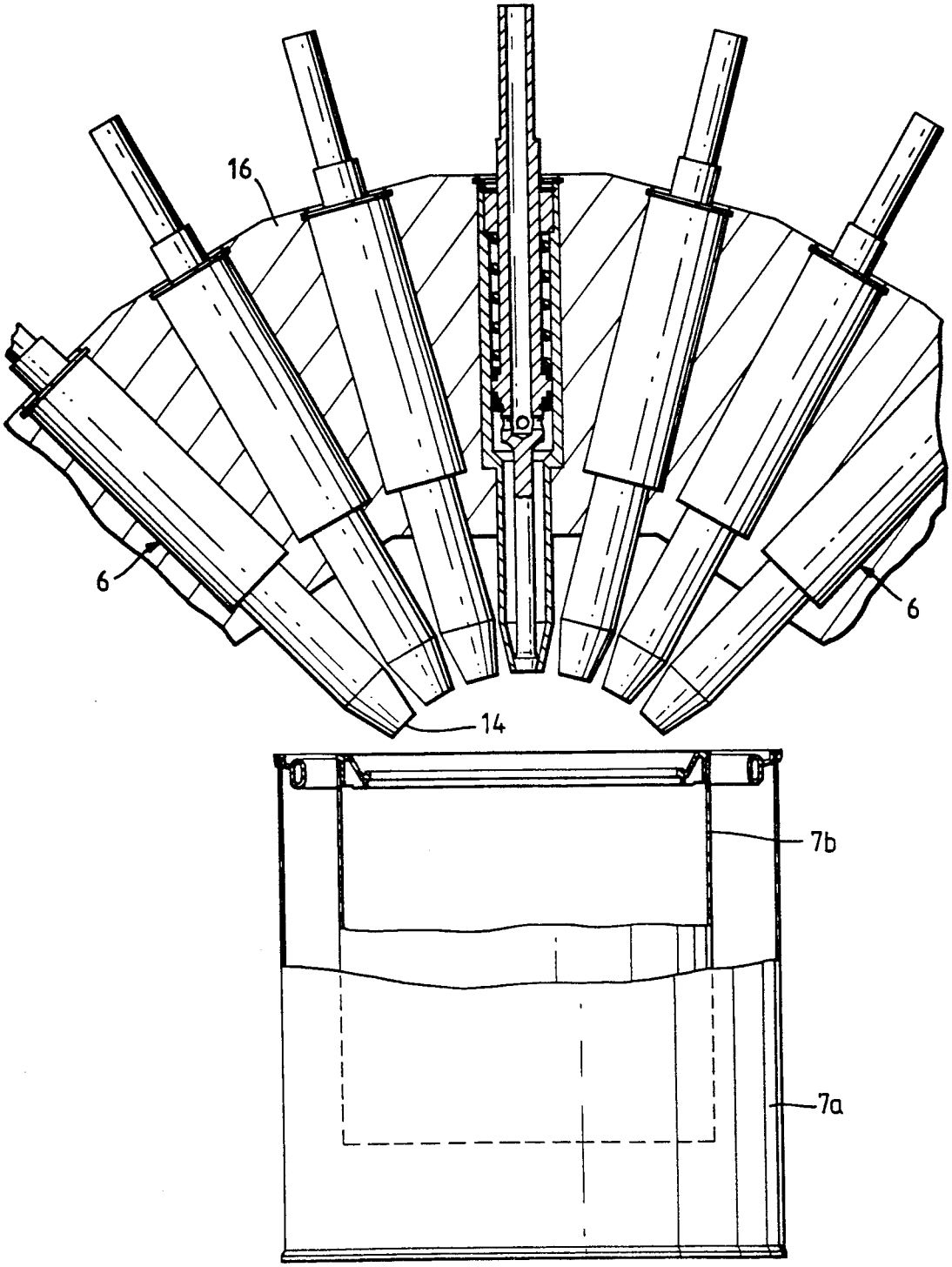
FIG. 5 shows to a larger scale than FIG. 2 an elevational view of a plurality of the dispensing valves grouped in conical formation above a target container.

The basic dispensing system for a single colour paint is shown in FIG. 1 and comprises a recirculation loop 1 around which the paint is continuously circulated under pressure by a pump 2 from and back to storage tank 3. Disposed in the loop 1 is a three-way control valve 4 which can be selectively operated to divert paint from the loop 1 into branch line 5 to dispensing valve 6 and from there into a container 7 (FIGS. 2 and 5).

Figure 2:
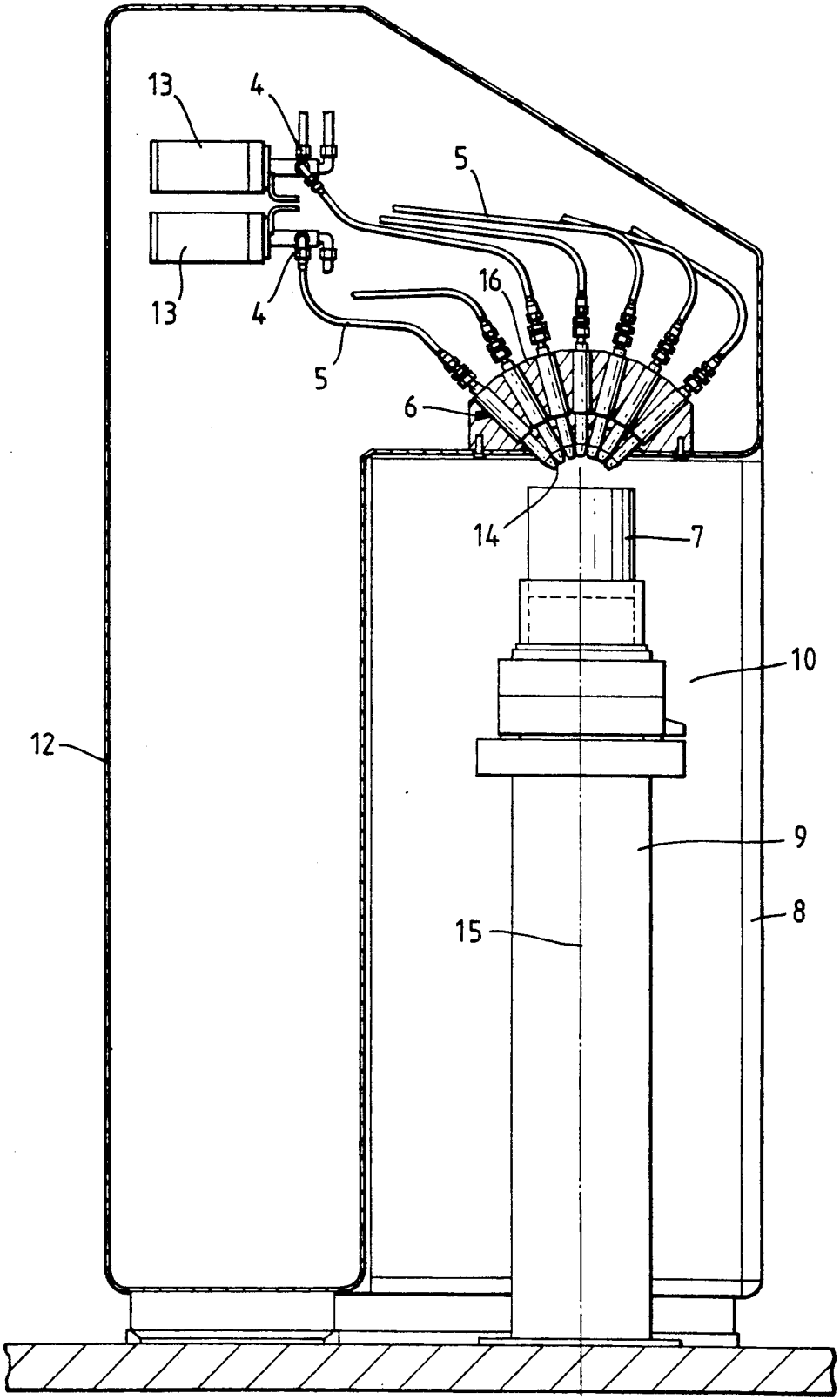
FIG. 2 shows in central section the general arrangement of the dispensing machine of the system.

Referring more particularly to FIG. 2 the dispensing machine itself comprises an inner casing 8 within which is disposed a pedestal 9 for supporting the paint container 7 at a filling station. In an alternative embodiment, the pedestal 9 can be replaced by a transporting conveyor which periodically stops when a container is at the filling station to allow the paint to be dispensed into it. The upper end of the pedestal 9 constitutes a weighing scale 10 for weighing the amounts of paint fed by the valves 6 to the container 7. An outer casing 12 surrounds the inner casing 8 and within this are disposed a series of the three-way valves 4 corresponding in number to the maximum number of basic colours to be dispensed by the machine. Each of the valves 4 has a respective pneumatic actuator 13. A respective branch line 5 leads from each valve 4 to a respective dispensing valve 6.

Figure 6:
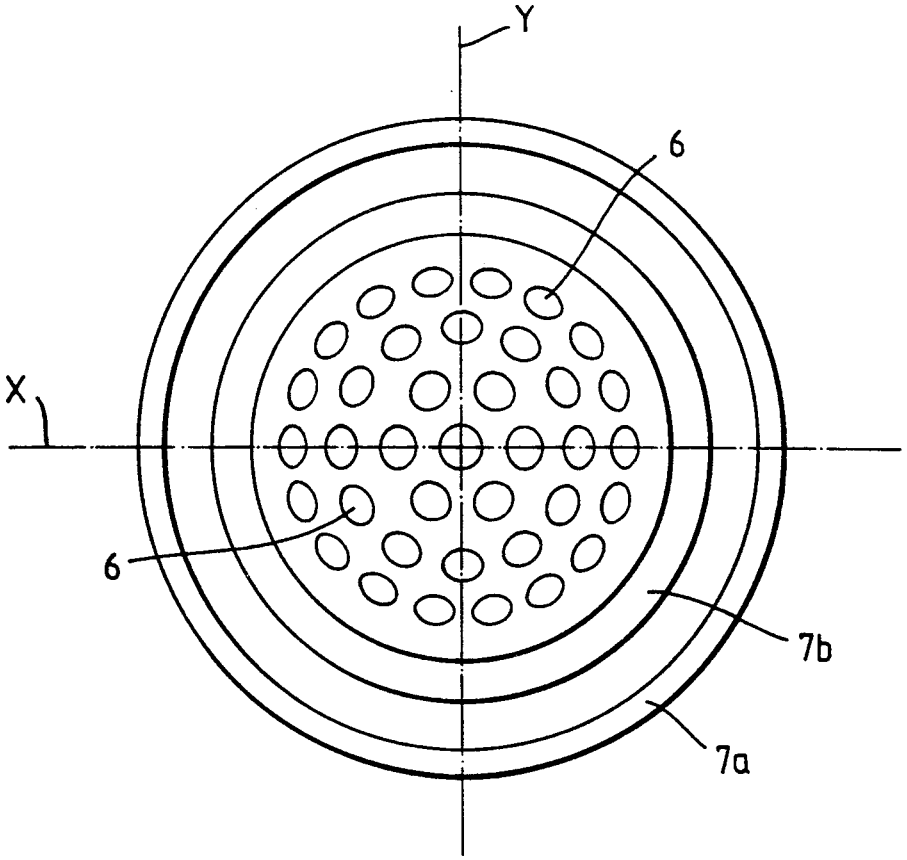
FIG. 6 shows a plan view of the plurality of dispensing valves.

Each of the valves 6 is of a slim elongated tubular design with a nozzle 14 at its lower end through which the paint is ejected into the container 7. From an inspection of FIGS. 2, 5 and 6 it can be seen that the valves 6 are arranged in an inverted conical formation with the nozzles 14 directed towards the apex of the cone, which lies within the container 7 and on the central vertical axis 15 thereof. In this particular example there is a group of thirty-seven dispensing valves 6. To provide the conical arrangement of the valves 6, they are mounted in respective bores of a common mounting block 16 which is supported on the top of inner casing 8. In FIGS. 5 and 6 are shown the position which two different sized containers referenced 7*a* and 7*b* would have relative to the nozzles 14.

Figure 3:
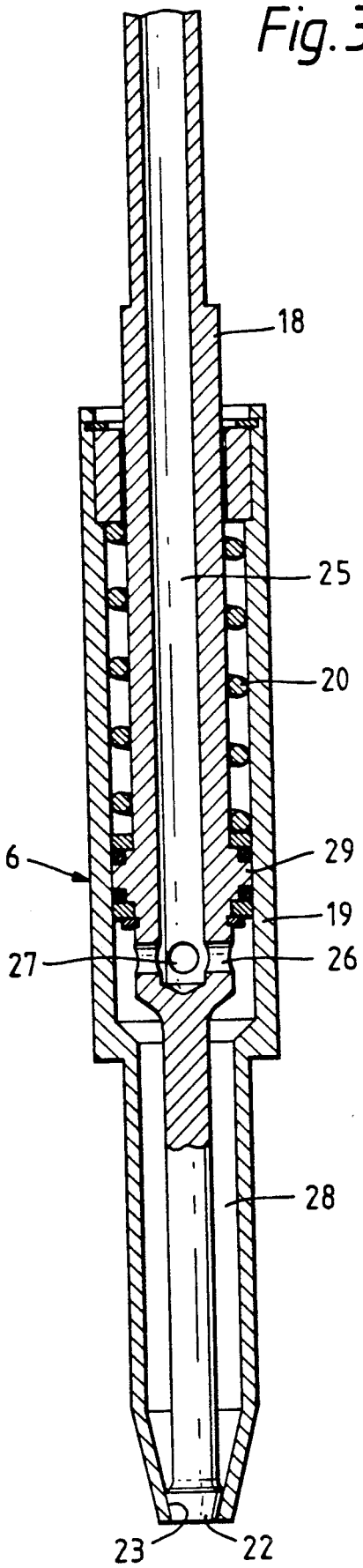
FIG. 3 shows a longitudinal section of the dispensing valve used in the system, the valve being illustrated in its closed position.
Figure 4:
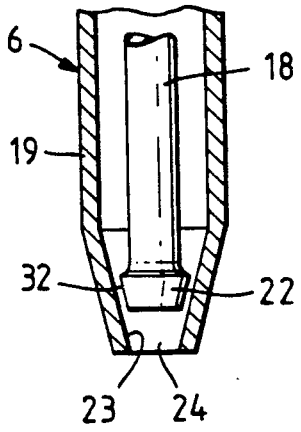
FIG. 4 is a fragmentary longitudinal sectional view showing the dispensing valve in its open position.

The construction of the dispensing valves is best seen in FIGS. 3 and 4. A valve stem 18 is slidable in an outer elongated tubular valve body 19 and is biased by spring 20 to a closed position in which the conical valve member 22 at the lower end of the stem 18 is urged into engagement with conical seat 23 at the nozzle 14 to close off outlet nozzle orifice 24. The valve stem 18 has a central bore 25 which terminates at its lower end in transverse bores 26 and 27. The upper end of the bore 25 provides a liquid inlet to the valve 6 and connects with one of the feed lines 5. Thus when the associated three-way valve 4 is operated paint flows along the feed line 5, through the bore 25 and out of the transverse bores 26 and 27 into the annular space 28 within the interior of the body 19 between the valve stem 18 and the lower part of the body 19.

The valve stem 18 is provided intermediate its ends with a piston formation 29 which is a close sliding fit in the upper part of the body 19. The periphery of the piston 29 has two 'O' rings which provide liquid-tight seals preventing paint escaping upwardly past the piston 29. When the associated control valve 4 is operated the flow of pressurised paint first fills the annular space 28 and then acts on the lower face of the piston 29 to cause it to move upwardly against the spring bias and thus corresponding upward movement of the valve stem 18 to cause the valve member 22 to move away from the valve seat 23 to fully open the valve to the position shown in FIG. 4 so that the paint passes through the orifice 24 into the container 7. As soon as the pressurised paint supply to the valve 6 is stopped by operation of the valve 4 to close off the feed line 5, the valve 6 is instantaneously closed under spring pressure.

Advantageously the weighing scale can be interfaced with a computer which controls the actuation of the pneumatic valves 13 to close off the paint supply to the container when the predetermined weight of paint has been delivered. In this way various refinements can be incorporated into the dispensing system by writing them into the computer software.

Although in the particular example there are thirty-seven dispensing valves, this number is to some extent arbitrary but arises from the geometric pattern shown in the plan view of FIG. 6 where one valve is at the centre, six in the next ring twelve in the next ring, eighteen in the next ring and so on. It is not necessary to have each valve the same size though this is naturally convenient. It could be that one or two or more valves are of a larger size for a particular application. For example, the centre valve may be very much larger than the others and used to supply the white paint which is normally required in larger quantities.

The valves 6 are as previously stated mounted in a machined block 16. The advantage of the particular construction and arrangement of the dispensing valves as described is that they can be made by automatic machining processes and are therefore low cost items which are simply popped into the mounting block and secured with a clip. This is a very important feature in use, since any maintenance problems can be very quickly dealt with by changing a valve rather than repairing it.

A lot of valves on the market for use in paint blenders appear to have been influenced by the design of automotive poppet valves as used in most motor cars. In this type of valve the valve stem or the male member moves away from the end of the valve body outside the valve body in order to open. This is an advantage in automobile engine design since the shape of the valve when open helps to spread the gas and the fuel charge around the cylinder. When this type of valve is used for dispensing paint it has a definite disadvantage, since the paint is directed into a divergent flow pattern which can cause excessive splashing. Equally if the valve does not open absolutely concentrically then one can get a jet of paint emerging preferentially from one side of the valve. This is not a trivial problem and indeed several examples are on the market where this phenomena presents itself and causes a considerable nuisance.

The controlling area for dispensing the paint is the area of the nozzle orifice. For maximum direction of the jet a convergent i.e. conical nozzle is required and therefore the actuated part i.e. the valve member must move inwards of the valve body towards the wider part of the cone. Given these two factors the design is carefully tuned so that the annular area 32 between the conical valve member 22 and the valve body 19 on the valve stem is equal to the area of the nozzle orifice 24 when the valve is in the position shown in FIG. 4. A feature of the design is therefore that the minimum overall area is achieved throughout by very careful matching of areas so that no part of the valve is bigger than it actually has to be in order to match other parts of the valve.

There are several advantageous reasons for the conical layout of the dispensing valves 6. One is that if one packs a number of nozzles together into the minimum possible area at the tip of the nozzles then they naturally tend to form a conical shape. The second reason for doing this is that it is an advantage to direct the paint to the centre of the container rather than simply to let it fall vertically downwards when it is near to the edge of the container. The third reason and possibly the most important ultimately is that the conical layout enables larger parts of the valve to be fitted on to a bigger pitch circle diameter. Thus if one needs relatively bulky springs or actuators fitted to the valve then these can be located at the opposite end of the valve to the nozzle where there is more space and where use of this space does not prejudice the ability to load a small container.

In the particular example shown, the valves are of simple conical shape and they are all directed towards the intersection of the X and Y axes shown in FIG. 6. One could have a variant on this where the angles of the cone are compounded such that one could, if one wished, promote swirl by arranging the valves in a conical pattern, but aimed at some point off the centre of the container when viewed in plan.

Since all dispensing valves are present over the container it is not necessary to move either the valves or the container in order to direct a number of paint streams to the container. This represents a very considerable advantage over other machines which are currently on the market. Since the rate of discharge is related to the size of the container it is perfectly possible to scale up this design such that if the container was 1 tonne size than 1 liter size then the valves would be larger in diameter but the arrangement would be the same and simply on a larger scale.

In the above described system, the valves 6 can open by anchoring the stem 18 and allowing the valve body to move downwards relative to the valve stem. Alternatively one can choose to anchor the valve body and permit the stem to move.

One of the most significant features of the above described system is that the dispensing valves do not need mechanical actuation at all. The valves are designed to be actuated by the hydraulic pressure of the paint. Thus there are very few moving parts in the valve and very little to go wrong. Since it is so simple it is very cheap to make.

A particular feature of the system described above is that the valve is very unlikely to leak when it is supposed to be closed. In most commercially available valves the pressure is still on the valve after the valve has closed and any small imperfections in the seating face will cause a leak. In the present system, however, the closing mechanism is simply one of falling pressure. In other words when the end of the dispense is reached the actuated three way valve is positioned so that paint flows back to the tank, the pressure drops in the line leading to the valve and the valve closes. Thereafter there is very little that can happen to cause the valve to leak. There is no pressure transmitted across the actuated three-way valve, hence the route back to the tank has been made easy and there is a considerable sealing force generated by the spring in the dispensing valve and nothing being supplied to overcome the force of that spring. In fact, with this particular design where the pressure is removed upstream of the valve when the valve is not required to operate, one has a situation where the valve is very unlikely to leak even if the valve seating became damaged a little by the odd paint particle or any other foreign body.

A further feature of the design of dispensing valve is that when closed the valve has the absolute minimum possible surface area available for paint to dry upon. Secondly as the valve closes it tries to expel the remaining drops of paint which is different to the other valves where the closing of the valves tends to splash paint on to the body of the valve. If paint is allowed to collect on the bottom of the valve it can build up and eventually form stalactites and in any case it is a nuisance since it can cause contamination. The most practical way to limit contamination is firstly to prevent the paint sticking there in the first place and then to limit the surface area such that if paint does stick there it is very small and minimal amount.

I claim:

1. A blending system for manufacturing a multiple-component liquid comprising:

a) a plurality of reservoirs for respective liquid components, b) a respective circulating path for each said liquid component from and to each respective said reservoir, c) pressurizing means for causing each said liquid component to circulate around the respective one of said paths, d) respective first valve means, each connected in a respective one of said paths and controllable to divert predetermined quantities of the respective liquid component from the path in which such first valve means is connected, e) a fixed-location filling station for stationarily locating a container centered on a vertical axis to receive the liquid components diverted from said circulating paths, f) respective extension lines each leading from a respective one of said first valve means, for conducting said diverted liquid components to said filling station, g) a plurality of second valve means stationarily disposed in a group at said filling station for dispensing paint into a container stationarily located at said filling station, each of said second valve means being connected to a respective one of said extension lines and comprising:

an outer, elongated two-ended, tubular valve body connected at one end to a respective said extension line and having an interior space, and an outlet orifice at its other end for a respective said liquid component, a valve seat surrounding said orifice internally of said elongated tubular valve body, and a valve member biased by biasing means within said elongated tubular valve body against said seat to close off the respective said orifice and to open by the force of hydraulic pressure of the respective diverted liquid component to permit the respective diverted liquid component to pass through the respective orifice;

each said valve seat being internally circumferentially conical so as to be convergent towards and substantially to the site of the respective said orifice so that the respective liquid component, when passing out through the respective said orifice tends to converge;

each said valve member being externally circumferentially conical substantially complementarily to the respective said valve seat, so that, as the respective second valve means closes, the respective said valve member tends to push out through said orifice such of the respective liquid component as is then disposed annularly between the respective said valve member and the respective said valve seat;

each said second valve means having a valve stem that has two ends and is axially slidable within the respective said valve body and carries the respective said valve member at one said end, a piston formation mounted on said valve stem at a position intermediate said ends of said valve stem, said valve stem having a bore extending from its opposite end, remote from the respective said valve member, said opposite end constituting a liquid inlet for the respective diverted liquid component, and opening into the respective interior space of the respective valve body at a position between the piston formation and the respective said valve member, whereby the respective diverted liquid component fed under pressure through said bore and into the interior space of said valve body displaces the piston formation against biasing provided by the respective said biasing means and hence causes the respective said valve member to move away from the respective said valve seat;

all of said second valve means in said group being arranged in a downwardly convergent conical formation having an apex, with all of said nozzles being directed towards said apex, with said apex located on said vertical axis; and each tubular valve body terminating at the respective said orifice.

2. A blending system according to claim 1, wherein:

each valve member and the respective said valve body in the fully open position of the respective said second valve means define between them an annular cross-sectional area which is substantially equal to the cross-sectional area of the respective said orifice.

3. A blending system according to claim 1, wherein:

each means providing said biasing is constituted by a respective coil spring located on the respective said valve stem on a side of the respective piston formation remote from the respective said valve member.

4. A blending system according to claim 3, wherein:

each of said elongated tubular bodies of said second valve means is stepped internally and externally part way along its length, to thereby provide a larger internal and external diameter extending from a respective resulting step, towards its end remote from the respective said orifice, and both the respective said piston formation and the respective said biasing means are located within the larger internal diameter portion of the respective said valve body.

5. A blending system according to claim 1, wherein:

a common mounting block is provided with a plurality of bores arranged in a conical configuration and each of said second valve means is removably mounted in a respective one of said bores.

* * * * *